US008928532B2

(12) United States Patent
Wu et al.

(10) Patent No.: US 8,928,532 B2
(45) Date of Patent: Jan. 6, 2015

(54) RADIATION COMPONENT OF MINIATURE ANTENNA

(75) Inventors: Zongda Wu, Guangdong (CN); Jiagang Liu, Guangdong (CN)

(73) Assignee: Shenzhen Aimic Technology Inc., Baoan District, Shenzhen, Guangdong (CN)

( * ) Notice: Subject to any disclaimer, the term of this patent is extended or adjusted under 35 U.S.C. 154(b) by 200 days.

(21) Appl. No.: 13/703,345

(22) PCT Filed: Mar. 7, 2011

(86) PCT No.: PCT/CN2011/071579

§ 371 (c)(1), (2), (4) Date: Dec. 10, 2012

(87) PCT Pub. No.: WO2012/119304

PCT Pub. Date: Sep. 13, 2012

(65) Prior Publication Data

US 2013/0135151 A1 May 30, 2013

(51) Int. Cl.

| | |
|---|---|
| ***H01Q 1/38*** | (2006.01) |
| ***H01Q 1/36*** | (2006.01) |
| ***H01Q 9/04*** | (2006.01) |
| ***H01Q 1/24*** | (2006.01) |
| ***H01Q 9/42*** | (2006.01) |

(52) U.S. Cl.

CPC ..... *H01Q 9/04* (2013.01); *H01Q 1/243* (2013.01); *H01Q 1/36* (2013.01); *H01Q 9/42* (2013.01)

USPC ..... 343/700 MS; 343/895

(58) Field of Classification Search

CPC ..... H01Q 1/243; H01Q 9/42; H01Q 1/36; H01Q 7/00; H01Q 5/0072

See application file for complete search history.

(56) References Cited

U.S. PATENT DOCUMENTS

| | | | | |
|---|---|---|---|---|
| 7,132,999 | B2 * | 11/2006 | Yamagajo et al. | 343/895 |
| 7,274,338 | B2 * | 9/2007 | Ozkar et al. | 343/793 |
| 8,207,893 | B2 * | 6/2012 | Baliarda et al. | 343/700 MS |
| 2006/0152429 | A1 * | 7/2006 | Pan | 343/895 |
| 2010/0214174 | A1 * | 8/2010 | Guan et al. | 343/700 MS |
| 2011/0140973 | A1 * | 6/2011 | Yamagajo et al. | 343/702 |
| 2011/0156968 | A1 * | 6/2011 | Qi et al. | 343/702 |
| 2011/0273343 | A1 * | 11/2011 | Qi et al. | 343/702 |

* cited by examiner

*Primary Examiner* — Trinh Dinh

(74) *Attorney, Agent, or Firm* — Tianhua Gu; Global IP Services

(57) ABSTRACT

A radiation component of a miniature antenna comprises an access part for transmitting signals, two first radiating structures mirrored upon a mirror line with each other and spacing at intervals, and a second radiating structure connected with the first structures. Every first radiating structure has a first circuit and a second circuit spacing at intervals and along a straight line substantially parallel to the mirror line, and a third circuit connecting the first circuit and the second circuit. The second radiating structure has two first circuits intersected with the extending lines of the first circuits in the first radiating structure, and a second circuit connecting the first circuits. The access part is electrically connected to an end of the first circuit in the first radiating structure which is far away from the mirror line.

17 Claims, 11 Drawing Sheets

RADIATION COMPONENT OF MINIATURE ANTENNA

CROSS REFERENCE TO RELATED PATENT APPLICATION

The present application is the US national stage of PCT/CN2011/071579 filed on Mar. 7, 2011, which claims the priority of the PCT patent application PCT/CN2011/071579 filed on Mar. 7, 2011, which application is incorporated herein by reference.

FIELD OF THE INVENTION

The invention relates to radiation components of an antenna, more specifically, to radiation components of a miniature antenna.

BACKGROUND OF THE INVENTION

Wireless communication products are being more and more diversified in the recent ten years and widely applied in daily life, and are required to be thin, aesthetic and portable to achieve convenience in usage, thus related miniaturized antenna designs are continuously proposed. The miniature antenna generally refers to an antenna having a space size much smaller than its operating wavelength, and theoretical study has pointed out that the radiation resistance of the miniaturized antenna is small with fairly low radiation efficiency.

As shown in FIG. 1, a meander line is provided which is disclosed in U.S. Pat. No. 5,892,490. The meander line includes a based member 12 and a radiation conductor 11 disposed within the base member 12 with continuous bending for resonance. In the meander line, to achieve the aim of miniaturization, the radiation conductor 11 must be bent many times and distributed densely within a smaller area, ensuring directions of electric currents being opposite in any two parallel and adjacent conductor segments 111 in the radiation conductor 11; further with more bending times, the distance between opposite electric currents formed separately in two equally adjacent and parallel conductor segments 111 is shorter, while with shorter distance between the two opposite electric currents, far-field counteraction generated by the two electric currents can be more severe, further leading to low radiation efficiency of the antenna.

When the radiation efficiency gets lower, not only unstable communications can be caused, a product adapting such antennas can also be more and more energy consuming, so electricity charging is often required, further resulting to inconvenience for users.

To design an antenna with fairly good performance at smaller space, in addition, as shown in FIG. 2, a radiation conductor of the antenna is adopted with a method such as fractal dimension extension in geometry algorithm of Hilbert curve; and representatives of such method, for example, those described in U.S. Pat. Nos. 7,148,805, 7,164,386, 7,202,822, 7,554,490, and US application publication No. US2007/0152886, and etc.

The Hilbert curve filling a plane 2 can non-interlace to pass through every split unit with equal area to form a pattern with fractal dimensions, thus theoretically, adopting such Hilbert curve as a design approach of the radiation conductor 11 can make the antenna achieve an effect of limitless miniaturization, but in fact, for the antenna applying such Hilbert curve, the increase in length of the distributed radiation conductor 11 in a specific area can make the number of conductor segments

111 which are adjacent, paired and parallel in the radiation conductor 11 increase and come closer to each other; additionally, the method of forming the radiation conductor 11 can also make electric current amplitude similar but opposite in phase for every paired conductor segments 111. When two electric currents with identical amplitude but opposite phase get closer, the two opposite electric currents counteract in far-field radiation and the resulted problem of radiation efficiency drop would be more serious, therefore in order to take into account of radiation efficiency of communications product specifications, the miniaturized method is restrained.

Additionally, features of various antennas with fractal dimension structure including Hilbert curve have been experimented and discussed in reference 1. Reference 1 illustrates that with an increase in fractal dimension and iterations number, the radiation efficiency and quality factor of antenna of the fractal dimension structure would decrease, wherein the antenna designed by Hilbert curve is the most serious, and the fixed relationship between resonance frequency and geometric dimension also restrains the degree of freedom in designing such type of antennas. Reference 1: J. M. Gonzalez and J. Romeu, "On the influence of fractal dimension on radiation efficiency and quality factor of self-resonant prefractal wire monopoles," 2003 IEEE International Symposium on Antennas and Propagation and USNC/CNC/URSI North American Radio Science Meeting, vol. 4, pp. 214-217, June, 2003.

SUMMARY OF THE INVENTION

The invention aims to resolve the technical problems and drawbacks of low radiation efficiency of antenna and imposed restraint after miniaturization of antenna, therefore, the objects of the invention, that is, to provide a first radiation component design of miniature antenna which can achieve miniaturization with radiation efficiency taken in account and with fairly good degree of freedom in design.

According to an embodiment of the present invention, a radiation component of a miniature antenna is provided. The miniature antenna is made by conductor materials, and includes an access part used to transmit signals, two first radiating structures mirrored upon a mirror line and spacing at intervals, and a second radiating structure connected with the first radiating structure. The first radiating structure has a first circuit, and a second circuit spaced at intervals and along a straight line which is substantially parallel to the mirror line, and further a third circuit connected with the first circuit and the second circuit.

The first line has a U-shaped unit, and the U-shaped unit has at least one U-shaped curve segment with an opening substantially parallel to the mirror line, further the access part is connected electrically to an end of the U-shaped unit. The second circuit has a U-shaped unit and an extended line segment, and the U-shaped unit has at least one U-shaped curve with an opening substantially parallel to a direction of the mirror line, further the extended line segment extends from one end of the U-shaped unit towards a direction of being far away from the opening. The third circuit has a U-shaped unit and two connecting line segments between the first circuit and the second circuit, and the U-shaped unit has at least one U-shaped curve segment with an opening substantially perpendicular to a direction of the mirror line. Further the connecting line segments respectively extend reversely from two ends of the U-shaped unit towards a direction of being far away from the U-shaped unit, and connect with one end of the first circuit which is corresponding to the access part and another end of the second circuit which is corresponding to the extended line segment. The second radiating structure is intersected with extended line segment of the second circuit in the first radiating structure.

For the radiation components of the miniature antenna in the invention described above, wherein, the end of the U-shaped unit of the first circuit is far away from the mirror line, and the U-shaped unit of the first circuit has an end close to the mirror line; the end of the U-shaped unit of the second circuit is far away from the mirror line, and the U-shaped unit of the second circuit has an end close to the mirror line; the first circuit also has a connecting line segment extending from the end of the U-shaped unit which is close to the mirror line, and the second circuit also has a connecting line segment extending from the end of the U-shaped unit close to the mirror line, further the connecting line segments of the third circuit are intersected respectively with the connecting line segment of the first circuit and the connecting line segment of the second circuit.

For the radiation components of the miniature antenna in the invention described above, wherein, the second radiating structure has a single arc circuit, and the single arc circuit is intersected with the extended line segments of the second circuit of the first radiating structure.

For the radiation components of the miniature antenna in the invention described above, wherein, the second radiating structure has a single straight circuit perpendicular to the mirror line, and the single straight circuit is intersected with the extended line segments of the second circuit in the first radiating structure.

For the radiation components of the miniature antenna in the invention described above, wherein, the second radiating structure has two first circuits connecting with each other and mirrored upon the mirror line; further the first circuits are intersected separately with the extended line segments of the second circuit in the first radiating structures.

For the radiation components of the miniature antenna in the invention described above, wherein, the second radiating structure further has a second circuit intersecting with the first circuit.

For the radiation components of the miniature antenna in the invention described above, wherein, the second circuit of the second radiating structure has a U-shaped unit and two connecting line segments, and the U-shaped unit has at least one U-shaped curve segment with an opening substantially parallel to the mirror line direction. Further the connecting lines segments respectively extend reversely from two ends of the U-shaped unit towards a direction of perpendicular and being far away from the mirror line.

For the radiation components of the miniature antenna in the invention described above, wherein, the U-shaped unit of the second circuit has at least one U-shaped curve segments, further openings of the two adjacent U-shaped curve segments are in the opposite direction with each other.

For the radiation components of the miniature antenna in the invention described above, wherein, the U-shaped unit of the second circuit has a single U-shaped curve segment.

For the radiation components of the miniature antenna in the invention described above, wherein, every first circuit of the second radiating structure has a longitudinal connecting line segment being parallel to the mirror line and intersecting with the connecting line segment of the second circuit in equal first radiating structures.

For the radiation components of the miniature antenna in the invention described above, wherein, the second circuit of the second radiating structure has a transverse connecting line segment intersecting with the longitudinal connecting line segment.

For the radiation components of the miniature antenna in the invention described above, wherein, the U-shaped unit of the first circuit has a single U-shaped curve segment.

For the radiation components of the miniature antenna in the invention described above, wherein, the U-shaped unit of the first circuit has at least one U-shaped curve segments, and openings of the two adjacent U-shaped units are in the opposite direction of each other.

For the radiation components of the miniature antenna in the invention described above, wherein, the U-shaped unit of the second circuit has a single U-shaped curve segment.

For the radiation components of the miniature antenna in the invention described above, wherein, the U-shaped unit of the second circuit has at least one U-shaped curve segments, and openings of the two adjacent U-shaped units are in the opposite direction of each other.

For the radiation components of the miniature antenna in the invention described above, wherein, the U-shaped unit of the third circuit has a single U-shaped curve segment.

For the radiation components of the miniature antenna in the invention described above, wherein, the U-shaped unit of the third circuit has at least one U-shaped curve segments, and openings of the two adjacent U-shaped units are in the opposite direction of each other.

In the implementation of the technical solution in the invention, the effect of the invention is to utilize a connection method of the first radiating structures and the second radiating structure distributed in the radiation components to achieve both miniaturization and improved radiation efficiency.

BRIEF DESCRIPTION OF THE DRAWINGS

The present invention is described in detail with reference to the following figures.

【Illustration of related component symbols】

| | |
|---|---|
| 10 | Monopole antenna |
| 11 | Radiation conductor |
| 111 | Conductor segment |
| 12 | Base member |
| 2 | Plane |
| 21 | Segmentation unit |
| 3 | Medium |
| 31 | Surface |
| 4 | Radiation component |
| 5 | First radiation structure |
| 51 | First circuit |
| 511 | U-shaped unit |
| 512 | Access part |
| 513 | Connecting line segment |
| 514 | U-shaped curve segment |
| 515 | Opening |
| 516 | End |
| 52 | Second circuit |
| 521 | U-shaped unit |
| 522 | Connecting line segment |
| 523 | Extended line segment |
| 524 | U-shaped line segment |
| 525 | Opening |
| 526 | End |
| 53 | Third circuit |
| 531 | U-shaped unit |
| 532 | Connecting line segment |
| 533 | U-shaped curve segment |
| 534 | Opening |
| 535 | End |
| 6 | Second radiation structure |
| 61 | First circuit |
| 62 | Second circuit |
| 621 | U-shaped unit |
| 622 | Connecting line segment |
| 623 | U-shaped curve segment |
| 624 | Opening |
| 625 | End |
| 7 | Chip |
| 8 | Printed circuit board |
| 81 | Substrate |
| 811 | First surface |
| 812 | Second surface |

-continued

【Illustration of related component symbols】

| | |
|---|---|
| 82 | Grounded metal part |
| 83 | 50 ohm microstrip line |
| 831 | First end |

DETAILED DESCRIPTION OF THE EMBODIMENTS

The aforementioned and other technical contexts, characteristics and effects related to the invention, with detailed illustration of eight preferred embodiments of referenced diagrams below, will be presented clearly.

Before the invention is described in detail, it is to be noted that in the contents note, similar components are shown by a same number.

Figure 1:
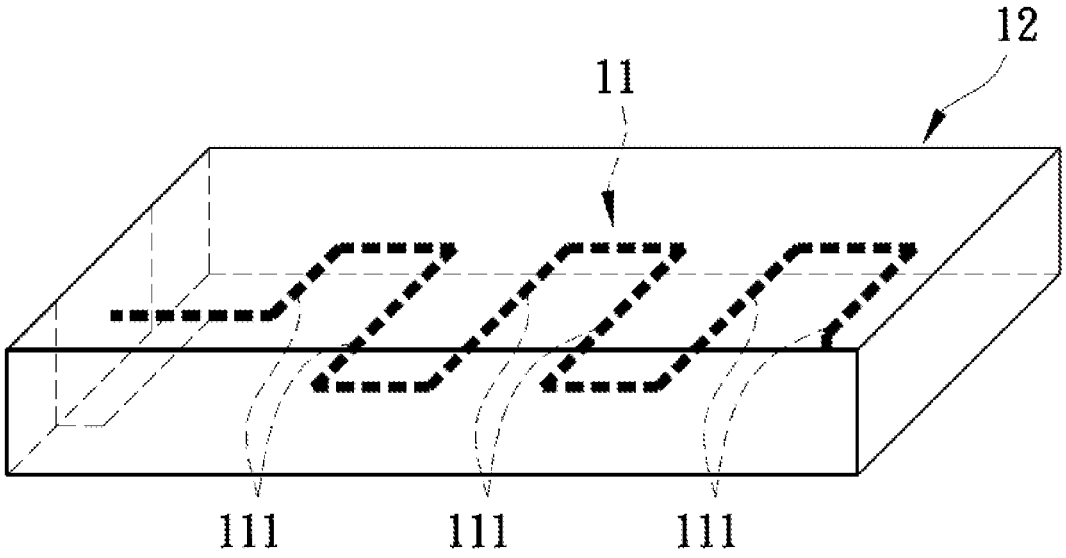
FIG. 1 is a schematic diagram of a radiation conductor of a known meander line antenna, illustrating that the radiation conductor is by way of meander line to achieve miniaturization.
Figure 2:
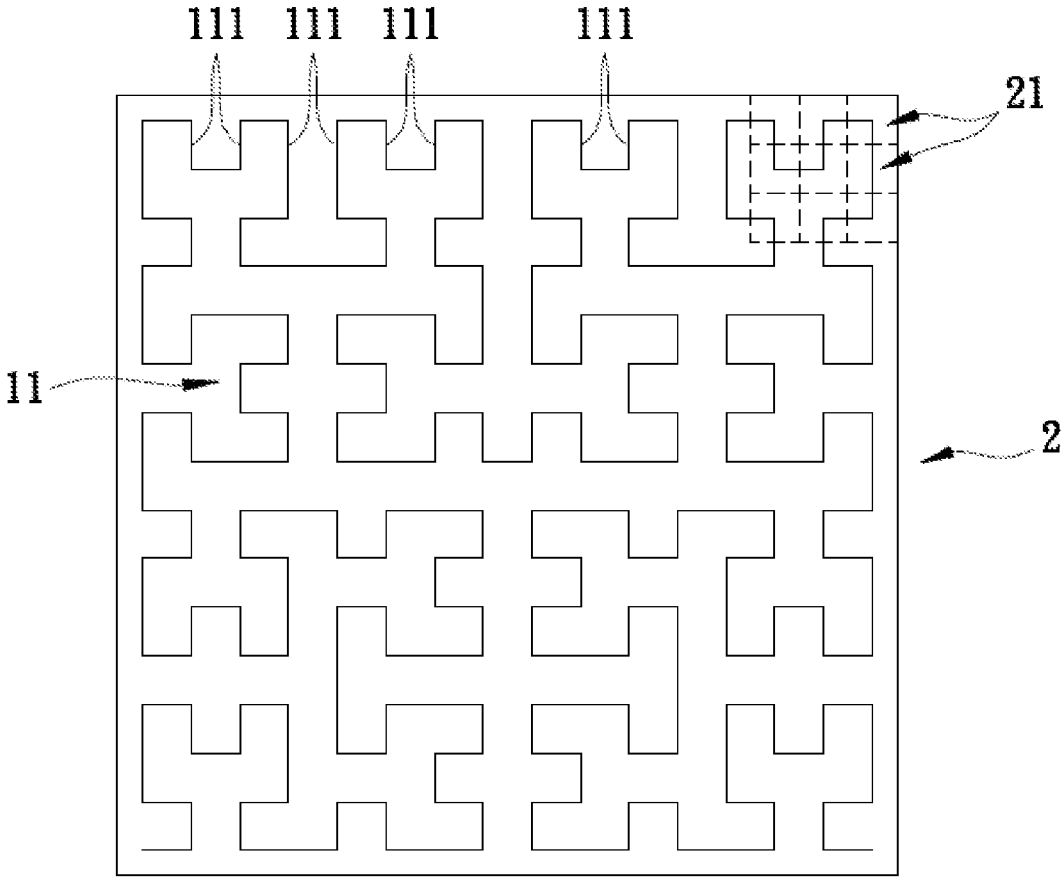
FIG. 2 is a known Hilbert curve, illustrating that a radiation conductor of an antenna adopts the method of bending in the Hilbert graph to achieve miniaturization.
Figure 3A:
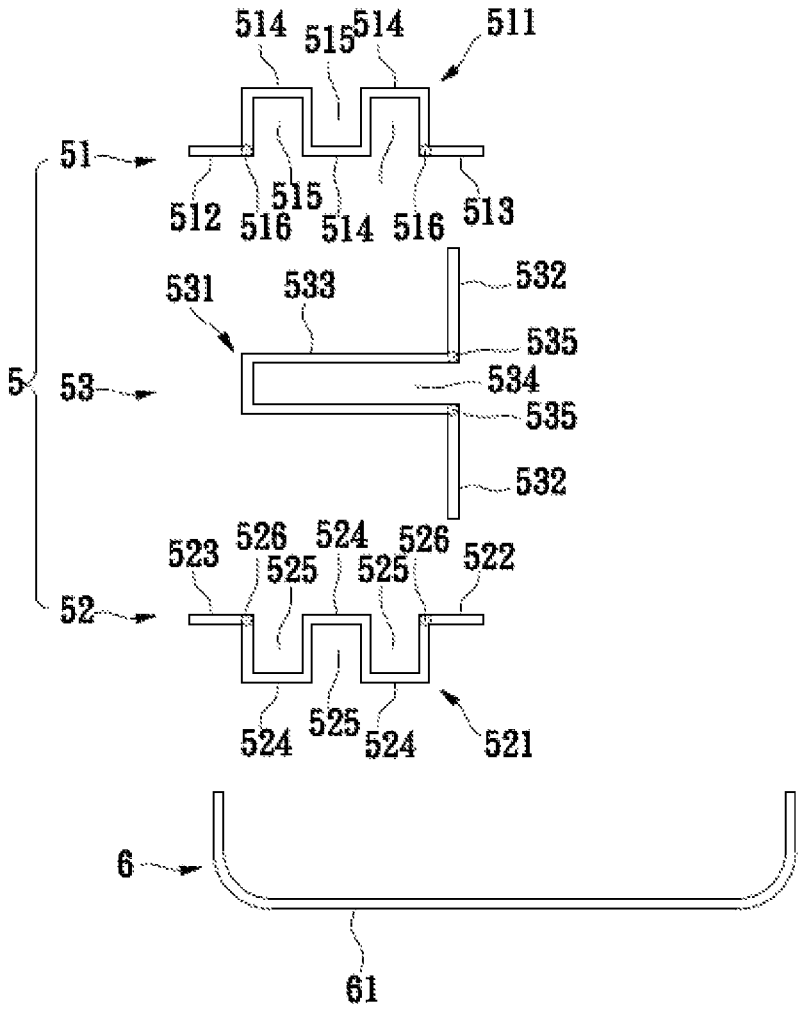
FIG. 3*a* is a decomposition schematic diagram of a radiation component of a miniature antenna in accordance with the first preferred embodiment of the present invention.
Figure 3B:
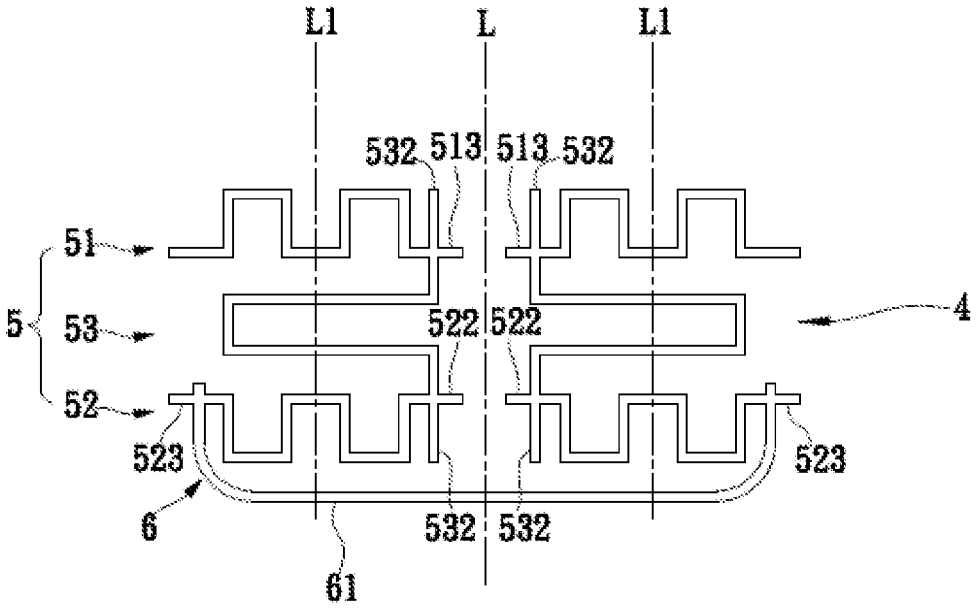
FIG. 3*b* is a schematic diagram of the first preferred embodiment, illustrating that a third circuit is in an X-shaped intersection with a first circuit and a second circuit respectively.

Refer to FIGS. 3*a* and 3*b*, a first preferred embodiment is provided. A radiation component 4 of a miniature antenna includes two first radiating structures 5 mirrored upon a mirror line L and spaced in intervals, and a second radiating structure 6 connected with the first radiating structures 5. The first radiating structure 5 has a first circuit 51, and a second circuit 52 spaced at intervals, and further a third circuit 53 connected with the first circuit 51 and the second circuit 52. The first circuit 51 and the second circuit 52 are placed along a straight line L1 which is substantially parallel to the mirror line L.

The first circuit 51 has a U-shaped unit 511, an access part 512 used to transmit signals, and a connecting line segment 513. The U-shaped unit 511 has three U-shaped curve segments 514 connected laterally and in sequence (that is along a direction substantially perpendicular to the mirror line L) and openings 515 of the U-shaped curve segments 514 are in a longitudinal direction (that is along a direction substantially parallel to the mirror line L). Further, two adjacent openings 515 of two U-shaped curve segments 514 are in an opposite direction. The access part 512 is electrically connected to an end 516 of the U-shaped unit 511 which is far away from the mirror line L, and the connecting line segment 513 extends from another end 516 of the U-shaped unit 511 which is close to the mirror line L, and towards the mirror line L in a direction substantially perpendicular to the mirror line L. Bending of U-shaped curve segments 514 in the U-shaped unit 511 can favor the miniaturization of the first circuit 51.

The second circuit 52 has a U-shaped unit 521, a connecting line segment 522 used to transmit signals, and an extended line segment 523. The U-shaped unit 521 has three U-shaped curve segments 524 connected laterally and in sequence, and openings 525 of the U-shaped curve segments 524 are in a longitudinal direction. Further, two adjacent openings 525 of two U-shaped curve segments 524 are in an opposite direction. The connecting line segment 522 extends from an end 526 of the U-shaped unit 521 which is close to the mirror line L, towards the mirror line L in a direction substantially perpendicular to the mirror line L. The extending line segment 523 extends from another end 526 of the U-shaped unit 511 which is far away with the mirror line L, and leaves the mirror line L in a direction substantially perpendicular to the mirror line L. Bending of U-shaped curve segments 524 in the U-shaped unit 521 can favor the miniaturization of the second circuit 52.

Figure 4:
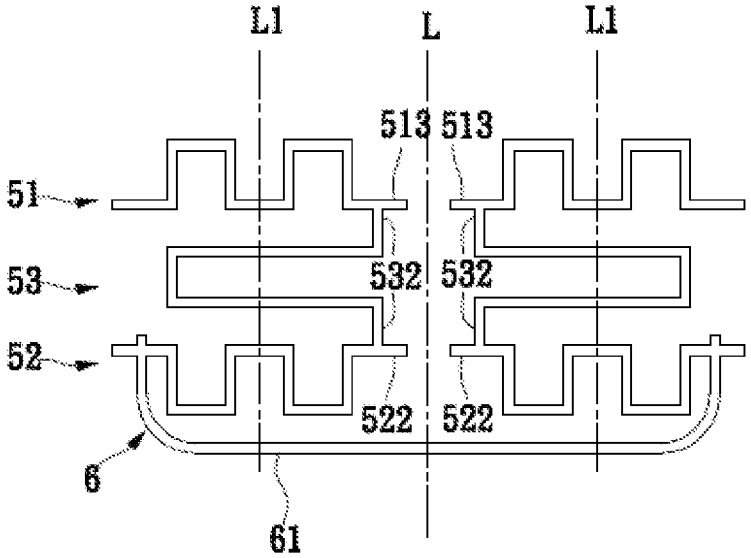
FIG. 4 is a schematic diagram of the first preferred embodiment, illustrating that the third circuit is in a T-shaped intersection with a first circuit and a second circuit of the first radiating structure respectively, and U-shaped units of the first circuit and the second circuit have multiple U-shaped curve segments, further the third circuit has a single U-shaped curve segment.
Figure 5:
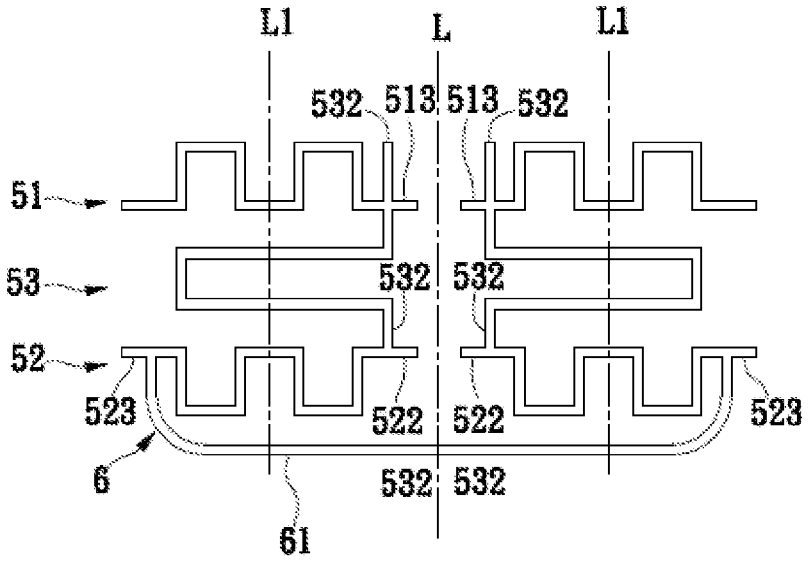
FIG. 5 is a schematic diagram of a radiation component of the first preferred embodiment, illustrating that the third circuit is in an X-shaped and a T-shaped intersection with a first circuit and a second circuit of the first radiating structure respectively.

The third circuit 53 has a U-shaped unit 531, and two connecting line segments 532 located between the first circuit 51 and the second circuit 52. The U-shaped unit 531 has a U-shaped curve segment 533 with a transverse opening 534, further the two connecting line segments 532 extends reversely and longitudinally from two ends 535 of the U-shaped unit 531 respectively and intersect with the connecting line segment 513 of the first circuit 51 and the connecting line segment 522 of the second circuit 52. It should be noted that the meaning of 'intersect' in the invention is, for example, the connecting line segment 522 and the connecting line segment 532 forms an X-shaped (cross-shaped) (as shown in FIG. 3) connection, or a T-shaped connection as shown in FIG. 4, or a connection with one end being an X-shape and another end being a T-shape.

Bending of U-shaped curve segments 533 in the U-shaped unit 531 can favor the miniaturization of the third circuit 53.

The second radiating structure 6 has a first circuit 61 with a single arc shape, and the first circuit 61 intersects with the extended line segment 523 in a second circuit 52 of the first radiating structure 5.

Figure 6:
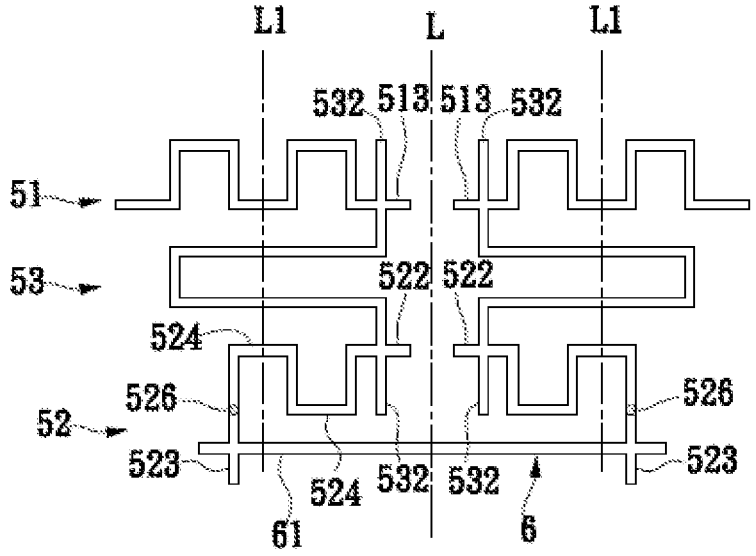
FIG. 6 is a schematic diagram of a second preferred embodiment of the invention, illustrating a preferred embodiment of a second radiating structure.

As shown in FIG. 6, the second preferred embodiment provides another radiation component which includes all components of the radiation component described in the first preferred embodiment, except that in the second circuit 52, the opening 525 of the U-shaped curve segment 524 being the most far away from the mirror line L and facing downward (far away from the first circuit 51). The extended line segment 523 extends downward from an end 526 of the U-shaped unit 521 which is far away from the mirror line L. The second radiating structure 6 has a first circuit 61 with a shape of a single straight line, and the first circuit 61 is substantially in a perpendicular intersection with the extended line segment 523 of the second circuit 52.

Figure 7:
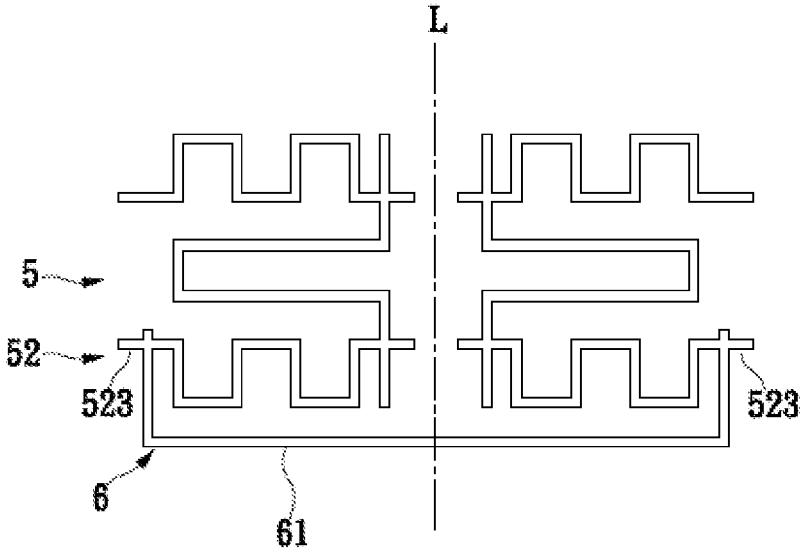
FIG. 7 is a schematic diagram of a third preferred embodiment of the invention, illustrating a preferred embodiment of a second radiating structure.

As shown in FIG. 7, the third preferred embodiment provides a further radiation component. The radiation component includes all components of the radiation component described in the first preferred embodiment, with the exception that the second radiating structure 6 has two first circuits 61 substantially connected to each other and mirrored placed upon the mirror line L, further the first circuit 61 intersects respectively with the extended line segments 523 of the second circuit 52 in the first radiating structure 5.

Figure 8:
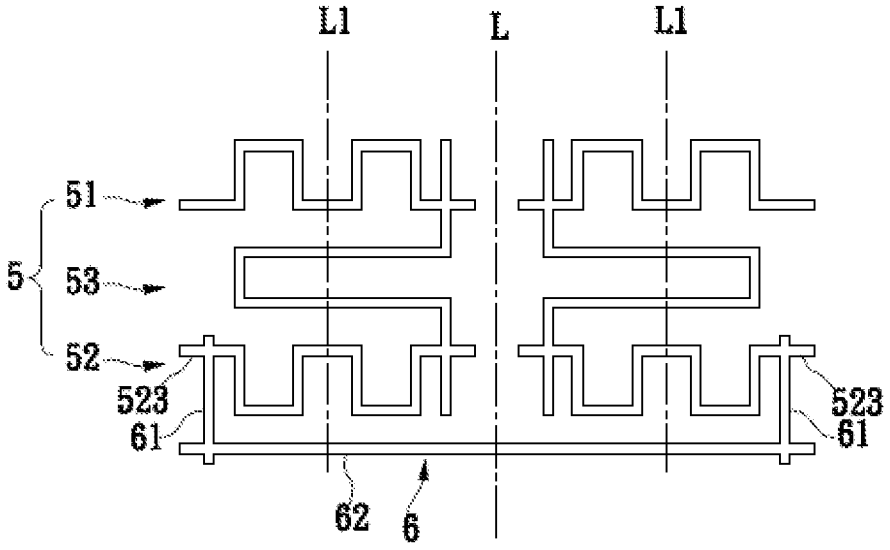
FIG. 8 is a schematic diagram of a fourth preferred embodiment of the invention, illustrating a preferred embodiment of a second radiating structure.

As shown in FIG. 8, the fourth preferred embodiment provides a further radiation component. The radiation component includes all components of the radiation component described in the first preferred embodiment, except that the second radiating structure 6 has a first circuit 61 extending downward and longitudinally, and a second circuit 62 substantially intersects with the first circuit 61. The first and second circuits 61, 62 are not substantially connected with each other, and are both intersected with the connecting line segments 523.

Figure 9:
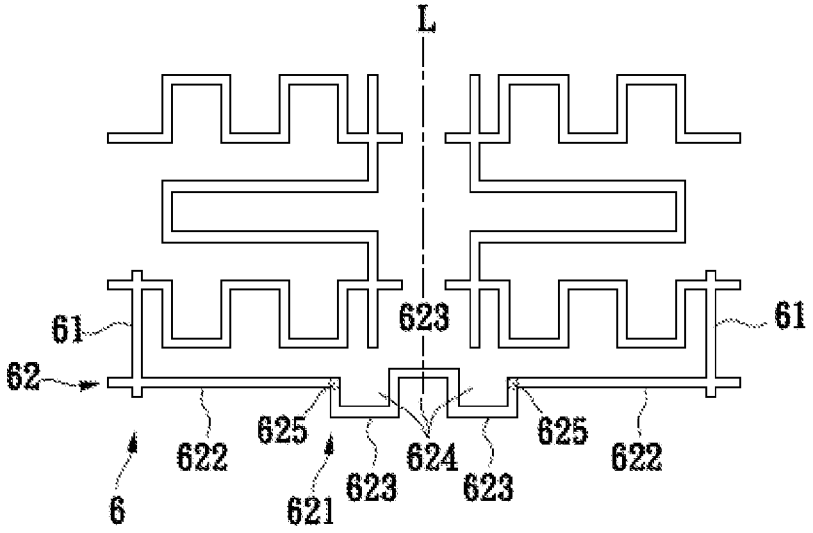
FIG. 9 is a schematic diagram of a fifth preferred embodiment of the invention, illustrating a preferred embodiment of a second radiating structure.

A shown in FIG. 9, the fifth preferred embodiment provides a further radiation component. The radiation component includes all components of the radiation component described in the fourth preferred embodiment, except that the second circuit 62 of the second radiating structure 6 has a U-shaped unit 621 located between the first circuit 61 and two connecting line segments 622. The U-shaped unit 621 has three U-shaped curves 623 connected laterally and in sequence, with openings 624 as longitudinal. The opening 624 of the U-shaped curve segment 623 located in the middle is in the opposite direction of the openings 624 of another two adjacent U-shaped curve segments located at two sides. The connecting line segments 622 extend reversely from two ends 625 of the U-shaped unit 621 respectively, and intersect respectively with the first circuits 61.

Figure 10:
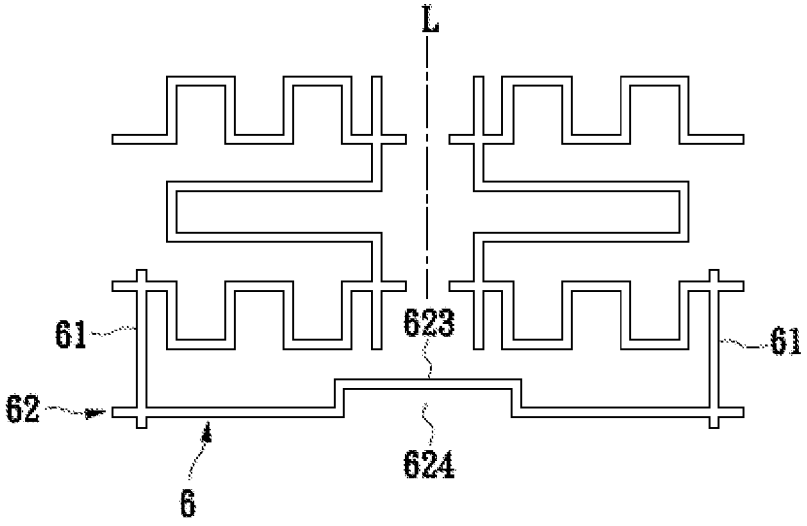
FIG. 10 is a schematic diagram of a sixth preferred embodiment of the invention, illustrating a preferred embodiment off a second radiating structure.

As shown FIG. 10, the sixth preferred embodiment provides a further radiation component. The radiation component includes all components of the radiation component described in the fifth preferred embodiment, except that the U-shaped unit 621 of the second circuit 62 in the second radiating structure 6 has a U-shaped curve segment 623 with a single longitudinal opening 624.

Figure 11:
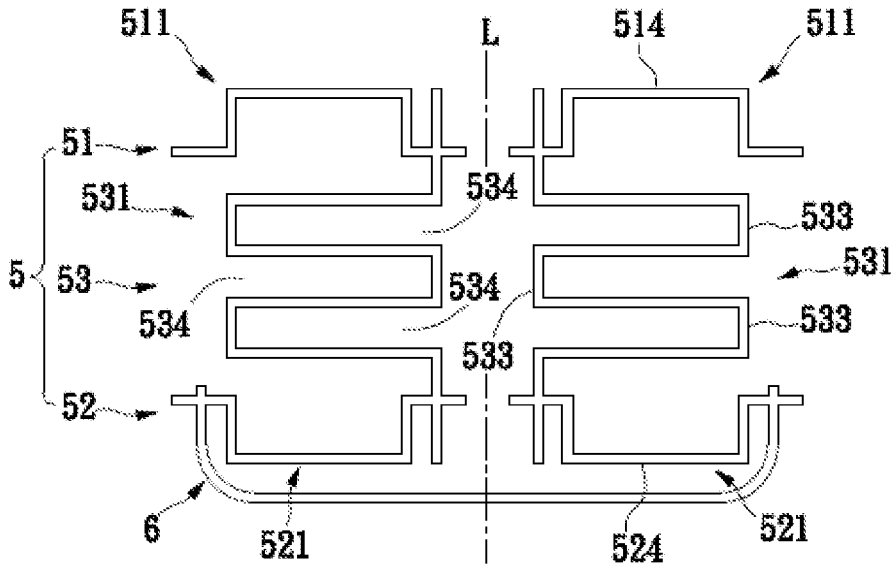
FIG. 11 is a schematic diagram of a seventh preferred embodiment of the invention, illustrating U-shaped units of a first and a second circuits in a first radiating structure each having a single U-shaped curve segment, and the third circuit has at least one U-shaped curve segments.

As shown in FIG. 11, the seventh preferred embodiment provides a further radiation component. The radiation component includes all components of the radiation component described in the first preferred embodiment (FIG. 3), except that the U-shaped unit 511 of a first circuit 51 in the first radiating structure 5 has a single U-shaped curve segment 514, and a U-shaped unit 521 of the second circuit 52 has a single U-shaped curve segment 524, further the U-shaped unit 531 of the third circuit 53 has three U-shaped curve segments 533 connected longitudinally and in sequence, with openings 534 as transverse.

Figure 12:
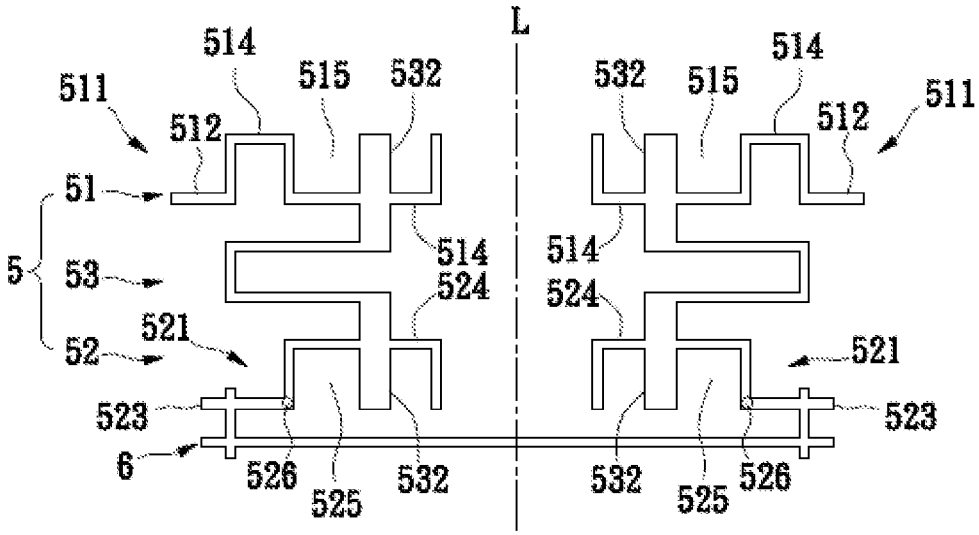
FIG. 12 is a schematic diagram of an eighth preferred embodiment of the invention, illustrating a third circuit of a first radiating structure in intersection with a U-shaped curve segment of the first circuit and the second circuit.

As shown in FIG. 12, the eighth preferred embodiment provides a radiation component substantially the same as that described in the fourth preferred embodiment (shown in FIG. 8), with the exception that the first circuit 51 of the first radiating structure 5 has an access part 512 and a U-shaped unit 511, and the U-shaped unit 511 has two U-shaped curve segments 514, further longitudinal openings 515 of the U-shaped curve segments 514 are in the opposite direction with each other. The second circuit 52 has a U-shaped unit 521 and an extended line segment 523, and the U-shaped unit 521 only has a U-shaped curve segment 524 with a longitudinal opening 525 (in an opposite direction of the opening 515), further the extended line segment 523 extends transversely from an end 526 of the U-shaped unit 521 which is far away from the mirror line L, towards a direction of being far away from the mirror line L. The connecting line segments 532 of the third circuit 53 is in intersection with the U-shaped curve segment 514 of the first circuit 51 that is close to the mirror line L, and the U-shaped curve segment 524 of the second circuit 52 respectively.

Figure 13:
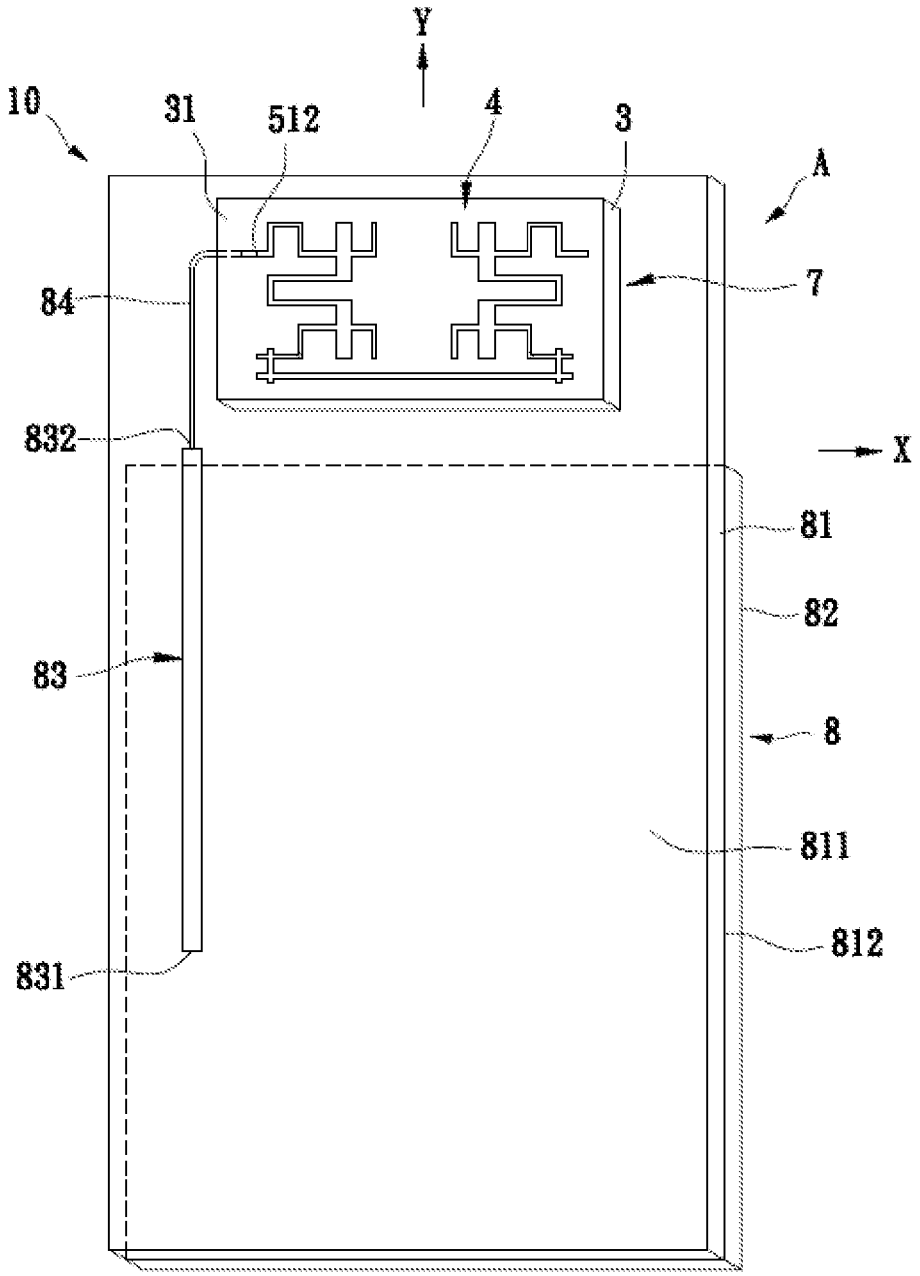
FIG. 13 is a schematic diagram of an antenna according to the eighth preferred embodiment.

As shown FIG. 13, the eighth preferred embodiment (shown in FIG. 12) provides a radiating components 4. Methods of printing, adhesion, sintering or the like can be applied to form a surface 31 on a medium 3, favoring the radiating components 4 and the medium 3 to form a chip 7. In FIG. 13, the eighth preferred embodiment is used for illustration, it should be understood that the radiation components 4 also can be any one that described in the first to the seventh embodiment. Further, the medium 3 can be formed by insulation materials, such as of glass fiber board, ceramic, plastic, styrofoam, Teflon, and etc.

Figure 14:
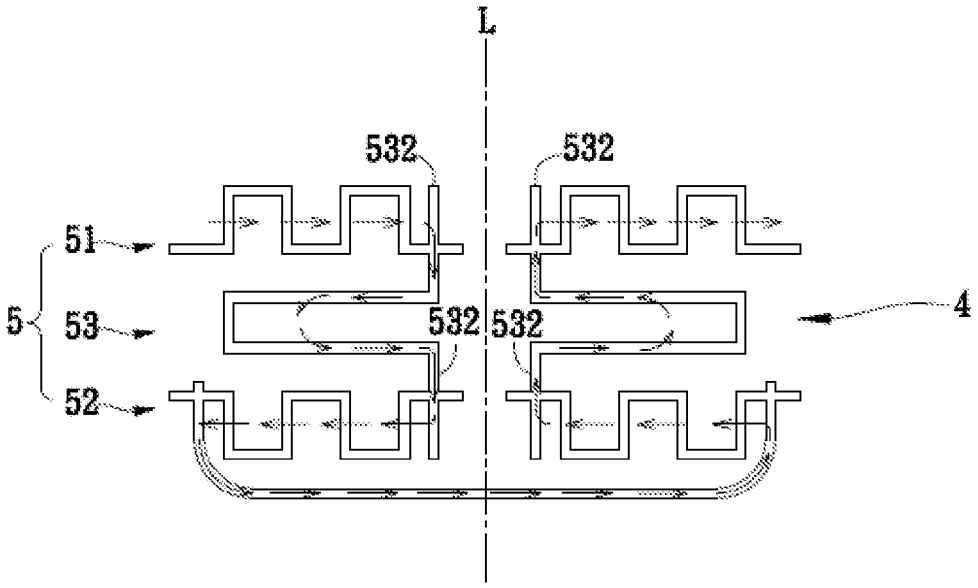
FIG. 14 is a schematic diagram of current distribution when excited in resonance in accordance with the first preferred embodiment.

The chip 7 can be disposed on a printed circuit board 8 of an electrical device (not shown in the figure), and the printed circuit board 8 includes a base member 81, a 50 ohm micro strip line 83, and a signal connecting line 84. The base member 81 includes a first surface 811 and a second surface 812. The 50 ohm micro strip line 83 is located at the first surface 811 of the base member 81, including a first end 831 and a second end 832. A grounded metal part 82 is located at a second surface 812 of the base member 81. The chip 7 is provided at the first surface 811 of the base member 81, further a clearance interval A surrounding the chip 7 does not have the grounded metal part 82. The signal connecting line 84 is electrically connected to the second end 832 of the 50 ohm micro strip line 83 and the access part 512 of the radiation components 4 in the chip 7. The first end 831 of the 50 ohm micro strip line 83 can be electrically connected with a transmitting and receiving end of the electrical device, further enabling signals to be transmitted, by sequence, go through the first end 831 of the 50 ohm micro strip line 83 to the second end 832, and via the signal connecting line 84 reaching the radiation components 4 to generate resonance then radiate. On the contrary, the principle remains then same when receiving signals, only with in an opposite transmission order. Additionally, when the radiation components 4 are excited to resonance, the grounded metal part 82 may generate another image current corresponding to an excited resonant electrical current of the radiation components 4, making the radiation components 4 and the grounded metal part 82 a monopole antenna 10. As shown in FIG. 14, when the radiation component of the first embodiment (shown in FIG. 3*a*, 3*b*) is excited, because of the connecting structure of the second radiation structure 6 and equal first structures 5, equivalent currents in the two first circuits 51 of the first radiation structure 5 are in a same direction, and equivalent currents of two second circuits 52 are in a same direction, further equivalent currents in two third circuits 53 are in an opposite direction. Currents in the first circuit 51 and the second circuit 52 are in an opposite direction; equivalent currents in the second radiation structure 6 remain in one direction. The equal currents in the same direction may increase the far-field radiation efficiency, while for the equal currents in the opposite directions, the problem of far field radiation counteraction can be solved by increasing the distance between each other or enlarging the current amplitude differences.

Although equivalent currents between the two adjacent third circuits 53 are in the opposite directions. However, due to the application of the two transverse U-shaped curve segments 531, the distance between two third circuits 53 can be equivalently increased, further eliminating the effect of decreased radiation efficiency caused by currents running in the opposite directions. Additionally, because the two third circuits 53 are connected in series between two second circuits 52 and the second radiating structure 6, current amplitude of the equal third lines 53 are not same. Further, as the total length of the second circuit 52 and the second radiating structure 6 increases, then t current amplitude differences between two third circuits 53 also increase, therefore equivalence distance between two third circuits 53 that carrying currents in the opposite direction can be increased by downsizing the U-shaped structure 531, and radiation efficiency can also be improved by adjusting the length of the second radiating structure 6 and two second circuits 52.

Although currents in the first circuit 51 and the second circuit 52 are in the opposite direction, because of not being adjacent to each other, the problem of far-field counteraction can be improved by increasing the distance between the first circuit 51 and the second circuit 52. Further, the U-shaped unit 531 of the third circuit 53 can be provided between the first circuit 51 and the second circuit 52, thus keeping a suitable distance therebetween. In addition, the length of the second structure 6 is fairly long and equivalent currents therein all remain in one direction, therefore the equivalent radiation efficiency can be fairly good. In summary, the above mentioned structure has fairly flexible design freedom, not limited to the fractal dimension designs such as Hilbert curves, thus an antenna containing this structure can achieve the object of both miniaturization and high radiation efficiency.

Table 1 below shows 3D radiation efficiencies of a monopole antenna (labeled as A) containing the structure described according to an embodiment of the present invention in FIG. 13, and a monopole antenna (labeled as B) having a radiation conducting wire designed with Hilbert curves, both operated in a frequency band range of 2.4-2.5 GHz. Spatial dimensions of chip in antenna B and chip 7 of the antenna A are the same, both having a size of 7 mm×3 mm×2 mm, further the size of electrical board 8 and structuring method of the two chip disposed in the electrical boards are the same with those in antenna B. Wherein, all the measured data and size sources of the antenna B are available from a chipped antenna (FR05-S1-N-0-102, Fractus, S. A.).

TABLE 1

| | Antenna A | Antenna B |
|---|---|---|
| Peak Radiation Efficiency % | 89 | 75 |
| Average Radiation Efficiency % | 85 | 70 |

In Table 1, it is can be seen that the average radiation efficiency and the peak radiation efficiency of various frequency points in the frequency band 2.4-2.5 GHz for the antenna A are both better than those for the antenna B, therefore the radiation components 4 of the antenna A in the invention can achieve both miniaturization and better radiation efficiency.

Figure 15:
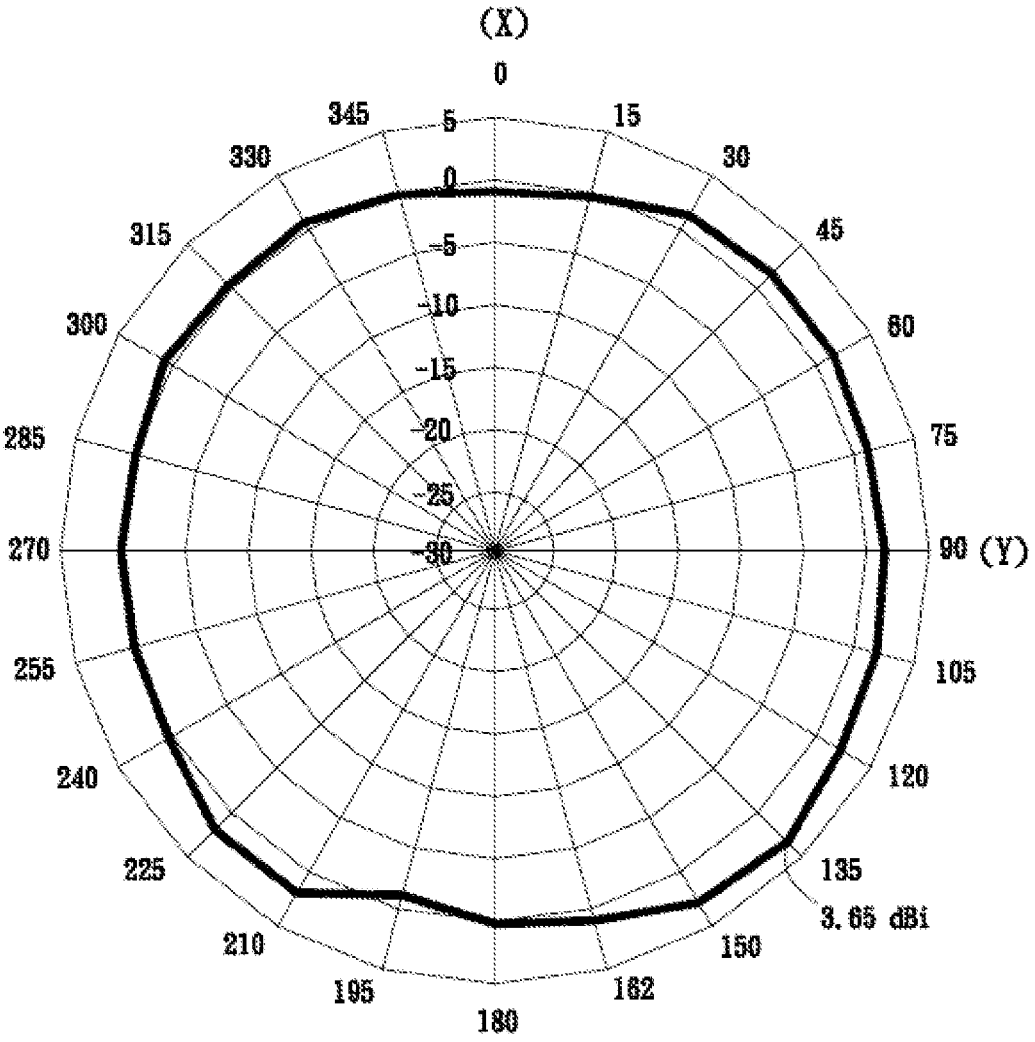
FIG. 15 is a radiation pattern of an antenna A according to the eighth preferred embodiment, illustrating a peak gain of 3.65 dBi.
Figure 16:
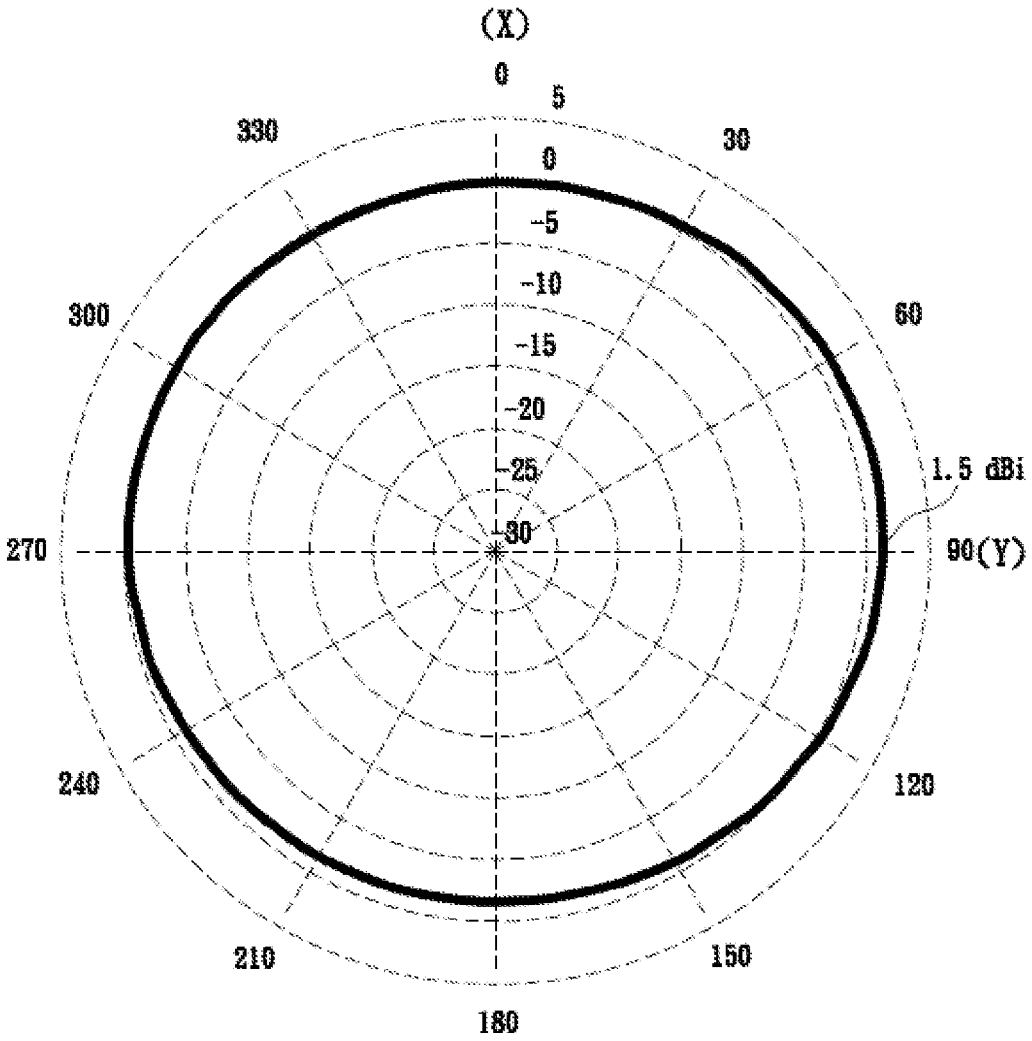
FIG. 16 is a radiation pattern of an antenna B adopting the Hilbert curve by design, illustrating a peak gain of 1.5 dBi.

As shown FIGS. 13, 15 and 16, the strongest radiation gain value of the antenna A (shown in FIG. 13) within 2.4-2.5 GHz frequency band is 3.65 dBi (shown in FIG. 15), higher than 1.5 dBi of antenna B (shown FIG. 16). So it can be concluded that radiation components 4 of the antenna A in the invention can concentrate radiation power at a certain direction to avoid waste during energy transmission in other non-communication directions, therefore also being able to achieve the object of energy saving. In summary, the radiation components 4 of the miniature antenna generate current bending through a U-shaped unit 511 of a first circuit 51 in the first radiation structure 5, a U-shaped unit 521 of the second circuit 52, and a U-shaped unit 531 of the third circuit 53. The U-shaped unit 531 of the third circuit 53 is provided between the first circuit 51 and the second circuit 52. Through the layout and connection format between the second radiating structure 6 and the two first radiating structures 5 which are mirroring with each other, the radiation components 4 of the antenna is can obtain both miniaturization and improved radiation efficiency, further achieving the effect of saving energy.

Although the described above are only preferred embodiments in the invention, the scope of implementation of the invention cannot be made by these embodiments, that is simple equivalent changes and modifications based on the scope of the claims and contents of the invention all fall into the scope of patent of the invention.

What is claimed is:

1. A radiation component of a miniature antenna, the radiation component formed by conductor materials, and including:

an access part for transmitting signals;

two first radiating structures mirrored upon a mirror line with each other and spacing at intervals, and every first radiating structure has a first circuit and a second circuit spacing at intervals and along a straight line substantially parallel to the mirror line, and a third circuit connected with the first circuit and the second circuit; wherein the first circuit has a U-shaped unit, and the U-shaped unit has at least one U-shaped curve with an opening substantially parallel to the mirror line, further the access part is connected electrically to an end of the U-shaped unit;

the second circuit has a U-shaped unit and an extended line segment, and the U-shaped unit has at least one U-shaped curve segment with an opening substantially parallel to the mirror line, further the extended line segment extends from an end of the U-shaped unit towards a direction being far away from the opening;

the third circuit has a U-shaped unit and two connecting line segments located between the first circuit and the second circuit; further the U-shaped unit has at least one U-shaped curve segment with an opening substantially perpendicular to the mirror line, and the connecting line segments respectively extend reversely from two ends of the U-shaped unit towards a direction of being far away from the opening, and connect with an end of the first circuit which is opposite to the access part and an end of the second circuit which is opposite to the extended line segment; and the radiation component further comprises a second radiating structure, and two ends of the second radiating structure intersect with two extended line segments of two second circuits of the first radiating structures.

2. The radiation component according to claim 1, wherein the end of the U-shaped unit of the first circuit is far away from the mirror line, and the U-shaped unit of the first circuit has an end close to the mirror line; the end of the U-shaped unit of the second circuit is far away from the mirror line, and the U-shaped unit of the second circuit has an end close to the mirror line; the first circuit also has a connecting line segment extending from the end of the U-shaped unit which is close to the mirror line, and the second circuit also has a connecting line segment extending from the end of the U-shaped unit which is close to the mirror line, further the connecting line segments of the third circuit are intersected respectively with the connecting line segment of the first circuit and the connecting line segment of the second circuit.

3. The radiation component according to claim 1, wherein the second radiating structure has a single arc circuit, and the arc circuit is intersected with the extended line segment of the second circuit of in the first radiating structure.

4. The radiation component according to claim 1, wherein the second radiating structure has a single straight circuit perpendicular to the mirror line, and the single straight circuit is intersected with the extended line segment of the second circuit in the first radiating structure.

5. The radiation component according to claim 1, wherein the second radiating structure has two first circuits connecting with each other and mirrored upon the mirror line; further the first circuits are intersected separately with the extended line segments of the second circuit of the first radiating structures.

6. The radiation component according to claim 5, wherein the second radiating structure also has a second circuit intersecting with the first circuit.

7. The radiation component according to claim 6, wherein the second circuit of the second radiating structure has a U-shaped unit and two connecting line segments, and the U-shaped unit has at least one U-shaped curve segment with an opening substantially parallel to the mirror line, further the connecting lines segments respectively extend reversely from two ends of the U-shaped unit towards a direction of being perpendicular and far away from the mirror line.

8. The radiation component according to claim 7, wherein the U-shaped unit of the second circuit has at least one U-shaped curve segments, and openings of the two adjacent U-shaped curve segments are in the opposite direction of each other.

9. The radiation component according to claim 7, wherein, the U-shaped unit of the second circuit has a single U-shaped curve segment.

10. The radiation component according to claim 5, wherein every first circuit of the second radiating structure has a longitudinal connecting line segment being parallel to the mirror line, and intersecting with a connecting line segment of the second circuit of the first radiating structure.

11. The radiation component according to claim 10, wherein the second circuit of the second radiating structure has a transverse connecting line segment intersecting with the longitudinal connecting line segment.

12. The radiation component according to claim 7, wherein the U-shaped unit of the first circuit has a single U-shaped curve segment.

13. The radiation component according to claim 1, wherein the U-shaped unit of the second circuit has at least one U-shaped curve segments, and openings of the two adjacent U-shaped curve segments are in the opposite direction with each other.

14. The radiation component according to claim 1, wherein the U-shaped unit of the second circuit has a single U-shaped curve segment.

15. The radiation component according to claim 1, wherein the U-shaped unit of the second circuit has at least one U-shaped curve segments, further openings of the two adjacent U-shaped curve segments are in the opposite direction with each other.

16. The radiation component according to claim 1, wherein the U-shaped unit of the third circuit has a single U-shaped curve segment.

17. The radiation component according to claim 1, wherein the U-shaped unit of the third circuit has at least one U-shaped curve segments, and openings of the two adjacent U-shaped units are in the opposite direction of each other.

* * * * *